US007427999B2

(12) United States Patent
Nakatsu

(10) Patent No.: US 7,427,999 B2
(45) Date of Patent: Sep. 23, 2008

(54) IMAGE FORMING APPARATUS

(75) Inventor: Haruhiko Nakatsu, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/750,731

(22) Filed: May 18, 2007

(65) Prior Publication Data

US 2007/0273747 A1 Nov. 29, 2007

(30) Foreign Application Priority Data

May 25, 2006 (JP) ..... 2006-145552

(51) Int. Cl.

| | |
|---|---|
| ***B41J 2/435*** | (2006.01) |
| ***B41J 2/47*** | (2006.01) |
| ***B41J 2/455*** | (2006.01) |
| ***B41J 15/14*** | (2006.01) |
| ***B41J 27/00*** | (2006.01) |

(52) U.S. Cl. ..... 347/232; 347/233; 347/241; 347/256

(58) Field of Classification Search ..... 347/232–233, 347/241, 256

See application file for complete search history.

(56) References Cited

U.S. PATENT DOCUMENTS

| | | | | |
|---|---|---|---|---|
| 6,853,397 | B2 * | 2/2005 | Onishi | 347/241 |
| 2003/0107641 | A1 * | 6/2003 | Nomura | 347/116 |
| 2004/0184830 | A1 * | 9/2004 | Miyamoto et al. | 399/66 |

FOREIGN PATENT DOCUMENTS

| | | | |
|---|---|---|---|
| JP | 5-035038 | A | 2/1993 |
| JP | 2005-202027 | A | 7/2005 |

* cited by examiner

*Primary Examiner*—Hai C Pham
*Assistant Examiner*—Kainoa B Wright
(74) *Attorney, Agent, or Firm*—Fitzpatrick, Cella, Harper & Scinto

(57) ABSTRACT

A first optical scanning device for scanning image data of colors (yellow, magenta, cyan and black) which serve as the basic for formation of color image employs an optical system having optical characteristic stable to changes in temperature in common, the optical system being incorporated in a single optical box. Inexpensive resin material is employed for its lens in a second optical scanning device for scanning image data of pale color or a special color having a large tolerance amount to color deviation or spot diameter. Further, an inexpensive second optical scanning device saving space is formed by reducing the optical path length.

6 Claims, 11 Drawing Sheets

IMAGE FORMING APPARATUS

BACKGROUND OF THE INVENTION

1. Field of the Invention

The present invention relates to an electrophotographic type or electrostatic recording type image forming apparatus having at least five image forming units for forming multi-color images, such as a copying machine and printer.

2. Description of the Related Art

With progress of the image forming apparatus in recent years, the demand for image quality has been increased and thus, an electrophotographic type image forming apparatus which adds additional colors to a conventional four-color image forming apparatus has been proposed. In such an apparatus, color toners such as pale cyan and pale magenta (hereinafter referred to as light cyan and light magenta) are added to conventional general four colors, yellow, magenta, cyan and black (Japanese Patent Application Laid-Open No. 05-35038). These pale color toners are added to intensify the image quality by reducing the granularity.

In some cases, a color difficult to reproduce by mixing yellow, magenta and cyan is formed as a special color like a printer.

As a configuration of the image forming apparatus using toners of not less than the four colors (hereinafter referred to as multi-colors), apparatuses shown in FIGS. 9 and 10 have been known (Japanese Patent Application Laid-Open No. 2005-202027).

In the tandem type shown in FIG. 9, development units 115*a* to 115*f* loaded with developers having different spectroscopic characteristics, respectively, are arranged in series corresponding to six image bearing members 111*a* to 111*f*. In this type, the output speed of an image can be equalized even if considering in basis of the four-color image forming apparatus, thereby providing a configuration emphasizing productivity. This system utilizes an intermediate transfer belt S as its intermediate transfer member.

However, the above-described technology has the following problems.

In the case of forming six colors using light cyan and light magenta in the tandem type considering productivity, a space which the image forming unit and the light scanning device require is 1.5 times compared with the image forming apparatus for forming the four colors.

Even if the interval of the image forming unit is decreased by reducing the sizes of a photosensitive drum, development units, cleaners and the like and changing the shape thereof for miniaturization, the height of the optical scanning device needs to be increased or a number of reflection mirrors for reflecting a light beam needs to be used because the optical scanning device has a predetermined optical path length.

As a method for reducing the space occupied by the optical scanning device, a method of reducing the optical path length is available. However, as a disadvantage due to reduction of the optical path length, there occurs a problem that the curvature of field is increased. That is, because a difference between a moving amount of light at an end portion and a moving amount of light at a central portion in a main scanning direction increases, the spot diameter of laser beam is different between the central portion and the end portion. Thus, if the optical path length of laser beam to be irradiated to the image bearing members for forming toner images using yellow, magenta, cyan and black toners is decreased, the sharpness of an image in the main scanning direction drops, which is a problem to be solved. Contrary to this, assume that the optical path length of the laser beam to be irradiated to an image bearing member for forming a toner image using an inconspicuous color such as pale toner or transparent toner is decreased. Even in such a case, when the freshness of the image in the main scanning direction drops, an influence upon the image is small because it is an inconspicuous color.

SUMMARY OF THE INVENTION

An object of the present invention is to reduce the area occupied by an optical scanning device while keeping an influence on an image low in an image forming apparatus having not less than five image forming units.

Another object of the present invention is to provide an image forming apparatus including: a plurality of image bearing members in which toner images are formed using toners of black, cyan, magenta and yellow; special color image bearing member in which toner image is formed using special color toner of different colors from said colors; first optical scanning means for exposing an image on said plurality of image bearing members; and second optical scanning means for exposing an image on said special color image bearing member, wherein each optical path length of respective laser beams irradiated to said plurality of image bearing members is longer than that of laser beam irradiated to said special color image bearing member.

A still another object of the present invention will be apparent from the following description.

DESCRIPTION OF THE EMBODIMENTS

Figure 1:
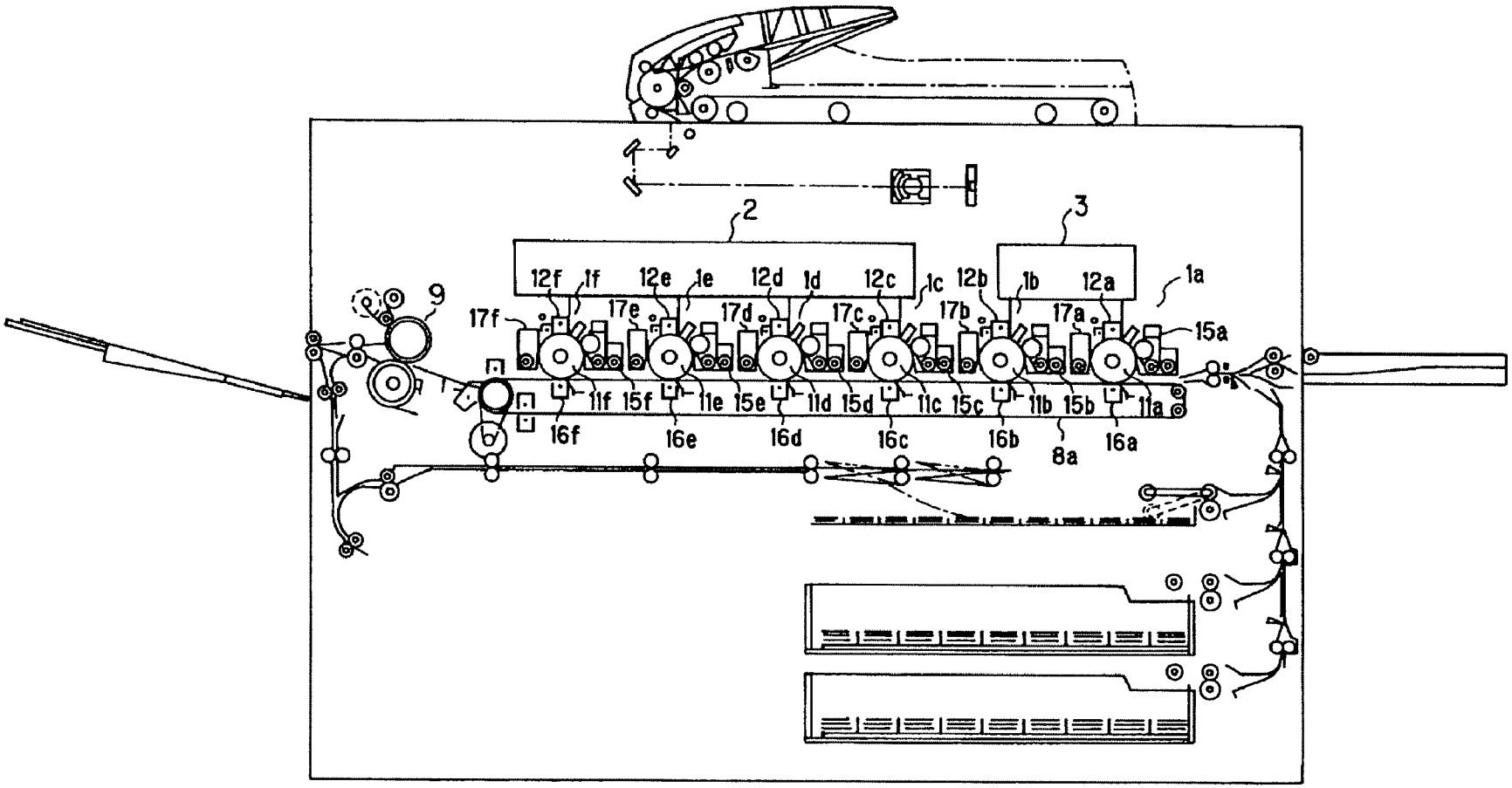
FIG. 1 is a diagram showing an image forming apparatus according to an embodiment of the present invention.

Hereinafter, one embodiment of the present invention will be described with reference to the accompanying drawings. Like reference numerals are attached to the same or corresponding components in all the drawings of the following embodiments. FIG. 1 shows an image forming apparatus according to an embodiment of the present invention. In this embodiment, a case of applying the present invention to a color image forming apparatus in which six color toners are transferred to a single transfer material (recording material) such that they are superimposed will be described.

In the image forming apparatus of the embodiment, as shown in FIG. 1, image forming units 1*a*, 1*b*, 1*c*, 1*d*, 1*e*, and 1*f* are arranged successively on the top of the endless belt-like transfer material conveying member 8*a* extending in the right and left directions. In the meantime, these image forming units 1*a*, 1*b*, 1*c*, 1*d*, 1*e* and 1*f* have the same configuration except for their toners.

Image bearing members (photosensitive drums) 11*a*, 11*b*, 11*c*, 11*d*, 11*e* and 11*f* on which toner images of respective colors are formed are arranged in the image forming units 1*a* to 1*f*. Image forming members are arranged around these image bearing members 11*a* to 11*f*. The image forming members include primary chargers 12*a* to 12*f* for charging the image bearing members, development units 15*a* to 15*f* for developing an electrostatic latent image formed by irradiating the image bearing member after charged with laser beam using toner, and cleaners 17*a* to 17*f* for cleaning remaining toners after transfer.

The development units 15*c* to 15*f* have toners of yellow, magenta, cyan and black stored therein, respectively.

The development units 15*a* and 15*b* have stored therein pale (light) toners (light magenta, light cyan as special colors) having high brightness and having the same hue as magenta and cyan.

Transfer chargers 16*a*, 16*b*, 16*c*, 16*d*, 16*e* and 16*f* are arranged on an opposite side to positions corresponding to the image bearing members 1*a* to 1*f* inside of an endless belt in the transfer material conveying member 8*a*.

A first optical scanning device 2 for irradiating the image forming units 1*c* to 1*f* with image exposure light is provided above the four image forming units 1*c*, 1*d*, 1*e* and 1*f*. A second optical scanning device 3 for irradiating the remaining two image forming units 1*a* and 1*b* with image exposure light is provided above the image forming units 1*a* and 1*b*.

Image signals corresponding to a plurality of component colors in an original are irradiated to the image bearing members 11*a* to 11*f* by these optical scanning devices 2 and 3, so that electrostatic latent images corresponding to respective component colors are formed on the image bearing members 11*a*, 11*b*, 11*c*, 11*d*, 11*e* and 11*f*, respectively.

In the image forming unit 1*a*, when the image bearing member 11*a* is rotated so that the electrostatic latent image reaches a development position opposing the development unit 15*a*, light magenta toner is supplied from the development unit 15*a* and a light magenta toner image is formed on the image bearing member 11*a*.

When this light magenta toner image reaches a transfer position located opposing the transfer charger 16*a*, a transfer material (not shown) is supplied to the transfer position until this time and a light magenta toner image is transferred to the transfer material by transfer bias with the transfer charger 16*a*.

When the transfer material then reaches the image forming unit 1*b*, the transfer material reaches the transfer position of the image forming unit 1*b* according to the same method as described above, so that light cyan toner image is formed to be superimposed on the already transferred light magenta toner image.

Thereafter, yellow, magenta, cyan and black toner images are superimposed successively on the transfer material also in the image forming units 1*c* to 1*f*. Subsequently, the transfer material having these six color toner images formed thereon is separated from the transfer material conveying member 8*a* and reaches a fixing unit 9. Then, the respective color toner images are melted and mixed with heat in the fixing unit 9 so as to form a color image. After the color image is fixed to the transfer material, it is discharged out of the device.

Residual toners that are not transferred on the image bearing members 11*a* to 11*f* are removed by the cleaners 17*a* to 17*f*. Residual electric charges on the image bearing members 11*a* to 11*f* are removed by charge removal lamps 13*a* to 13*f*. Toners and electric charges are cleaned by the cleaners 17*a* to 17*f* and the charge removal lamps 13*a* to 13*f*, so that the respective image bearing members 11*a* to 11*f* turn into preparatory state which enables a subsequent image forming operation to be executed.

Figure 2:
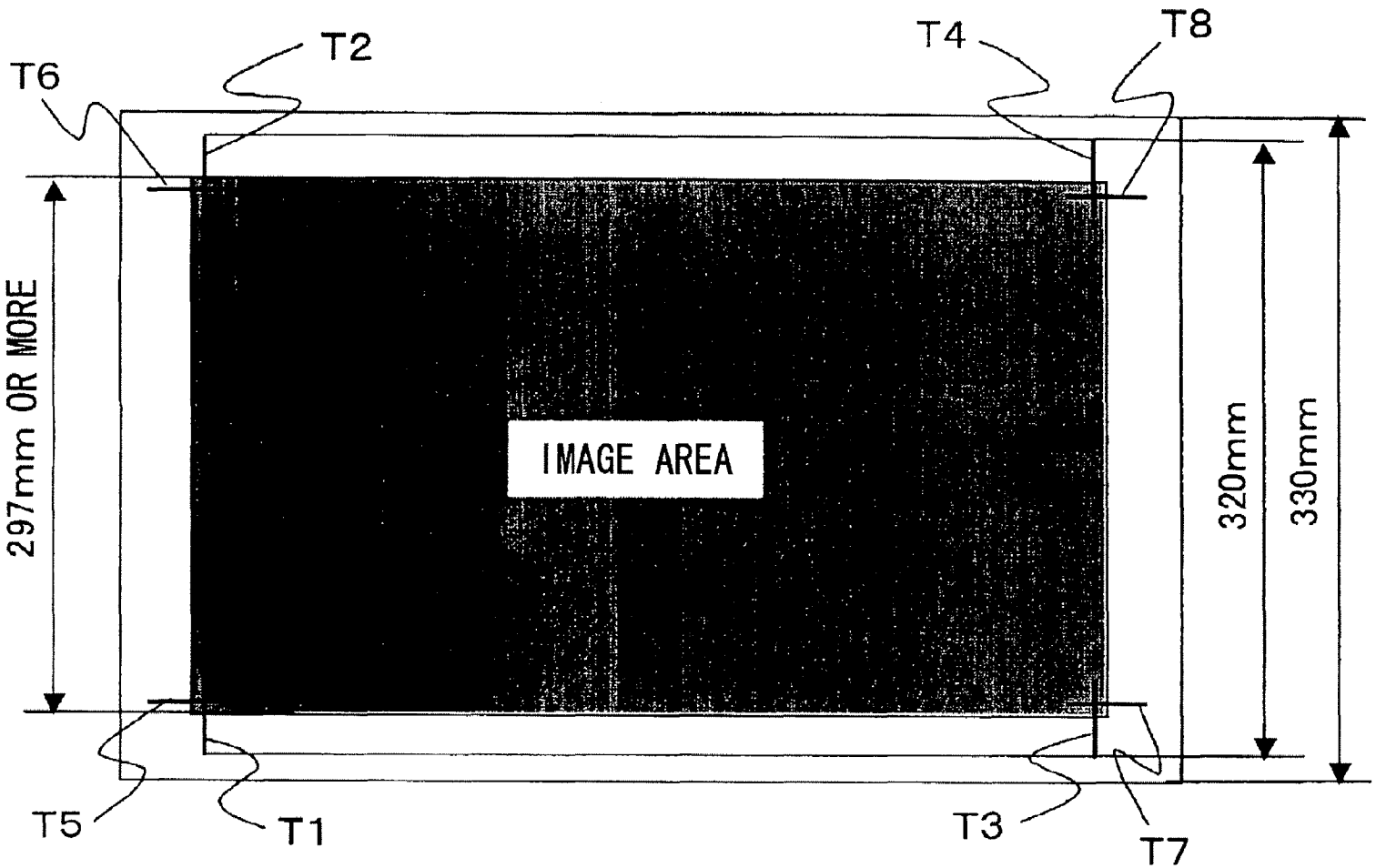
FIG. 2 is a diagram showing a transfer material for use in the image forming apparatus according to this embodiment of the present invention.

The image forming apparatus of this embodiment can convey a transfer material of 330 mm in length in the main scanning direction as shown in FIG. 2 and form an image of 297 mm or more in length. Cutting marks T1 to T8 may be formed as a criterion for cutting outside an image area in the main scanning direction and sub-scanning direction of an image. The length from one end portion of the cutting mark to the opposite side end portion in the main scanning direction is 320 mm.

(Configuration of First Optical Scanning Device)

The first optical scanning device 2 of the image forming apparatus of this embodiment in the above-described image forming process has the following configuration.

Figure 3:
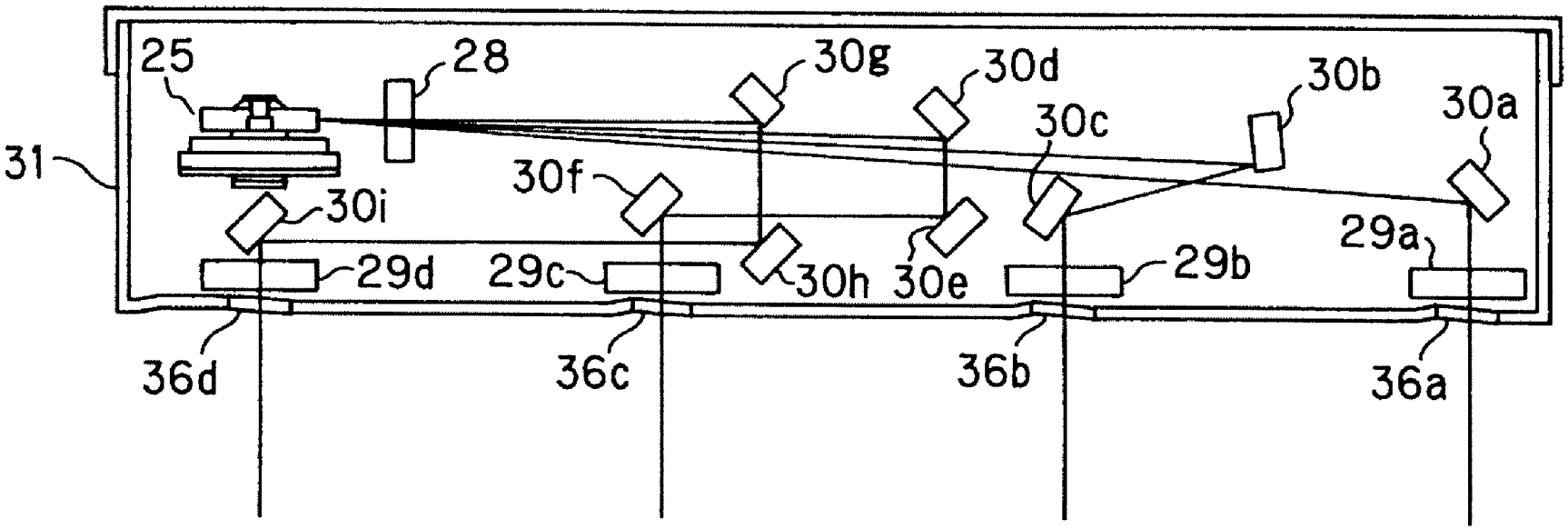
FIG. 3 is a main sectional view of a first optical scanning device of the image forming apparatus according to this embodiment of the present invention.
Figure 4:
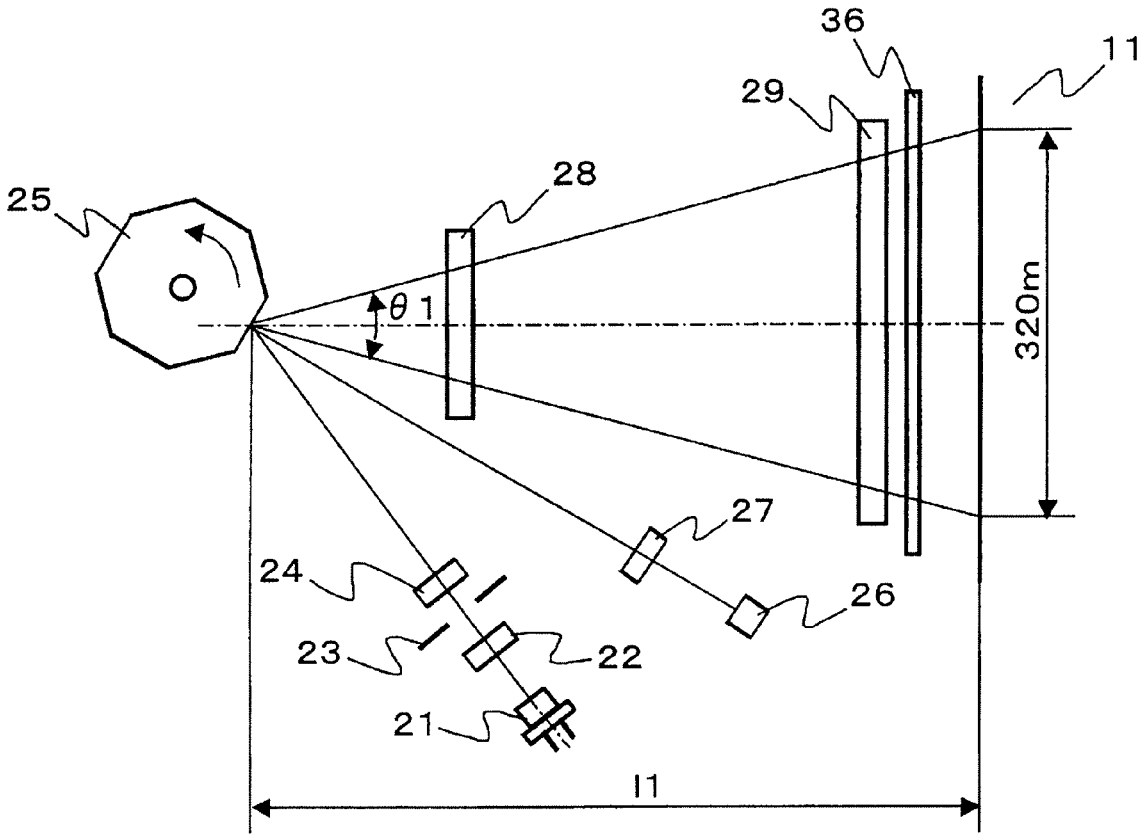
FIG. 4 is a plan exploded view of the first optical scanning device of the image forming apparatus according to this embodiment of the present invention in a state in which a reflection mirror thereof is removed.

FIG. 3 is a main sectional view of the first optical scanning device of this embodiment, and FIG. 4 shows a plan exploded view of the first optical scanning device in a state in which a reflection mirror is removed. As the plan exploded view, only one root of scanning light is shown because the other roots are constructed in the same manner.

In FIGS. 3 and 4, reference numeral 21 denotes a light source device, which uses a semiconductor laser. Reference numeral 22 denotes a collimator lens, which turns a beam irradiated from the light source device to a substantially parallel beam.

After a flux of light is restricted by an aperture 23, only light in the sub-scanning direction is collected by a cylindrical lens 24 and irradiated linearly to near a reflecting surface of a polygon mirror (rotary polygon mirror) 25.

Reference numeral 25 denotes a polygon mirror which scans and deflects emitted laser beam, which has eight reflecting surfaces. The polygon mirror is rotated in the direction of an arrow in the figure. Reference numeral 26 denotes synchronism detecting means, which uses a photodiode. Reference numeral 27 denotes a lens for focusing the light beam onto the photodiode which is the synchronism detecting means. When the light beam deflected and scanned by the polygon mirror passes the synchronism detecting means, it detects a synchronous signal, and after a predetermined time elapses, image data is written. Reference numeral 28 denotes a first image focusing lens for spot imaging laser beam onto a drum, and reference numerals 29*a* to 29*d* (described as 29 in FIG. 4) each denote a second image focusing lens for spot imaging the laser beam on the drum together with the first image focusing lens, and each are called fθ lens with the first image focusing lens. In such an optical scanning device, the incident angels of all beams are set different so that each beam reflected and scanned by the polygon mirror is separated from others before it reaches the drum. For this reason, the first image focusing lens is constructed of a cylinder lens which has no refracting power in the sub-scanning direction. Reference numerals 30*a* to 30*i* each denote a return mirror for reflecting a laser beam having passed through the first image focusing lens in a predetermined direction. Reference numeral 31 denotes an optical box which supports and fixes respective optical elements. Reference numerals 36*a* to 36*d* (described as 36 in FIG. 4) each denote a dust-proof glass. In this embodiment, the first image focusing lens 28 and the second image focusing lenses 29*a* to 29*d* correspond to an image focusing optical element of the present invention. In this embodiment, the first optical scanning device is an optical unit which can be attached/detached from the image forming apparatus.

In the first optical scanning device, the collimator lens 22 and the cylindrical lens 24 are adjusted in the direction of light beam at the time of assembly in order to obtain an optimum spot diameter on the drum. Further, it has a desired optical path length 11 to suppress the curvature of the field, and a common depth among all image heights is large, thereby achieving small spots.

In the first optical scanning device, a laser beam is emitted from each of four light sources including the light source device 21, and all the beams are deflected and scanned in the rightward direction in the figure by the polygon mirror arranged at the end portion. At this time, all the beams are deflected and scanned by an identical reflecting surface.

The first optical scanning device writes image data in a range of an angle θ1 while light beam is deflected and scanned, and the scanning area at this time is a range 320 mm in which the cutting marks (mark to be attached for cutting, book making or multi-color printing) can be formed. Reference numeral 11 denotes an optical path length in the first optical scanning device. In this embodiment, it is 500 mm long.

In the first optical scanning device, the first image focusing lens 28 allows four light beams to pass therethrough and is used in common. The first image focusing lens is formed of a resin material. The first image focusing lens may be formed of glass to suppress color deviation due to a rise in temperature of the image forming apparatus.

In the first optical scanning device corresponding to yellow, magenta, cyan and black, which are basic for color image formation, an optical system having consistent optical characteristics is adopted, and the lens is communized or a glass lens is used to make it difficult for color deviation with a passage of time to occur due to rise in temperature of the image forming apparatus. Additionally, a small spot beam can be achieved to provide an image having a high sharpness.

(Configuration of Second Optical Scanning Device)

Figure 5:
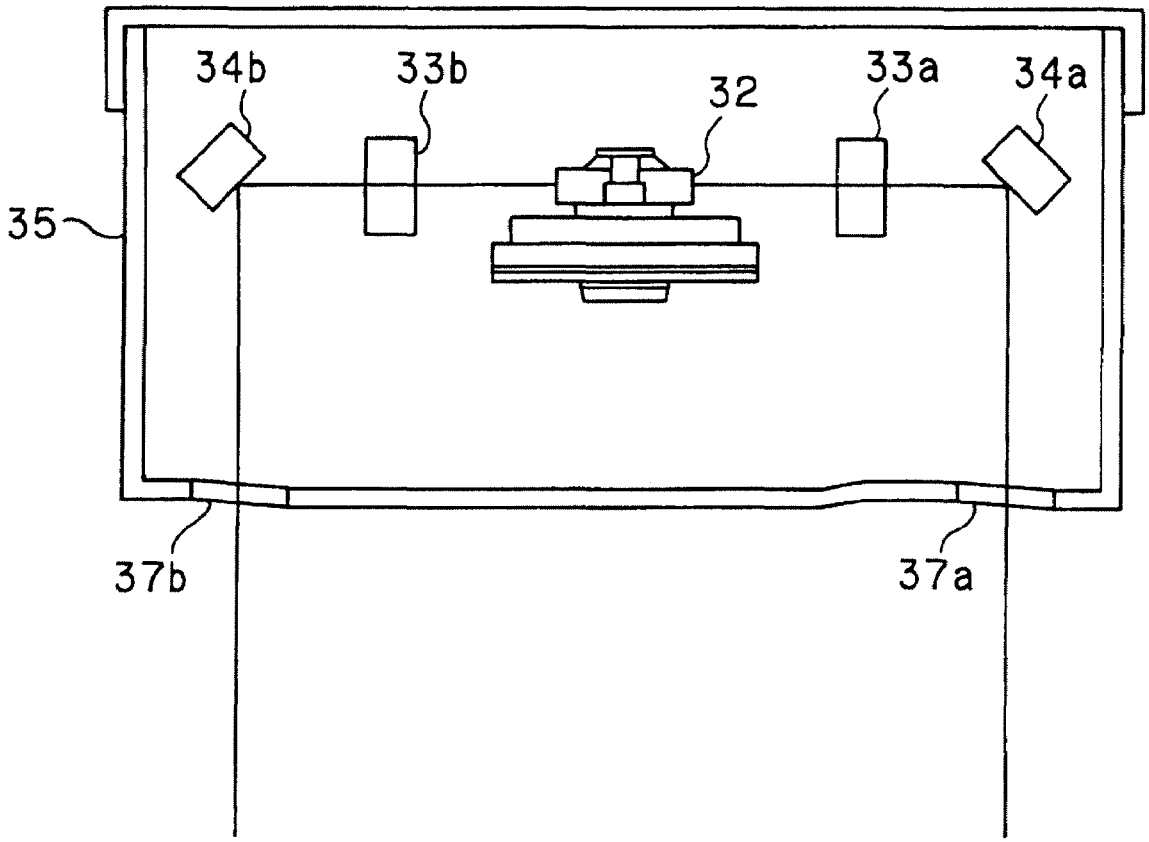
FIG. 5 is a main sectional view of a second optical scanning device of the image forming apparatus according to an embodiment of the present invention.
Figure 6:
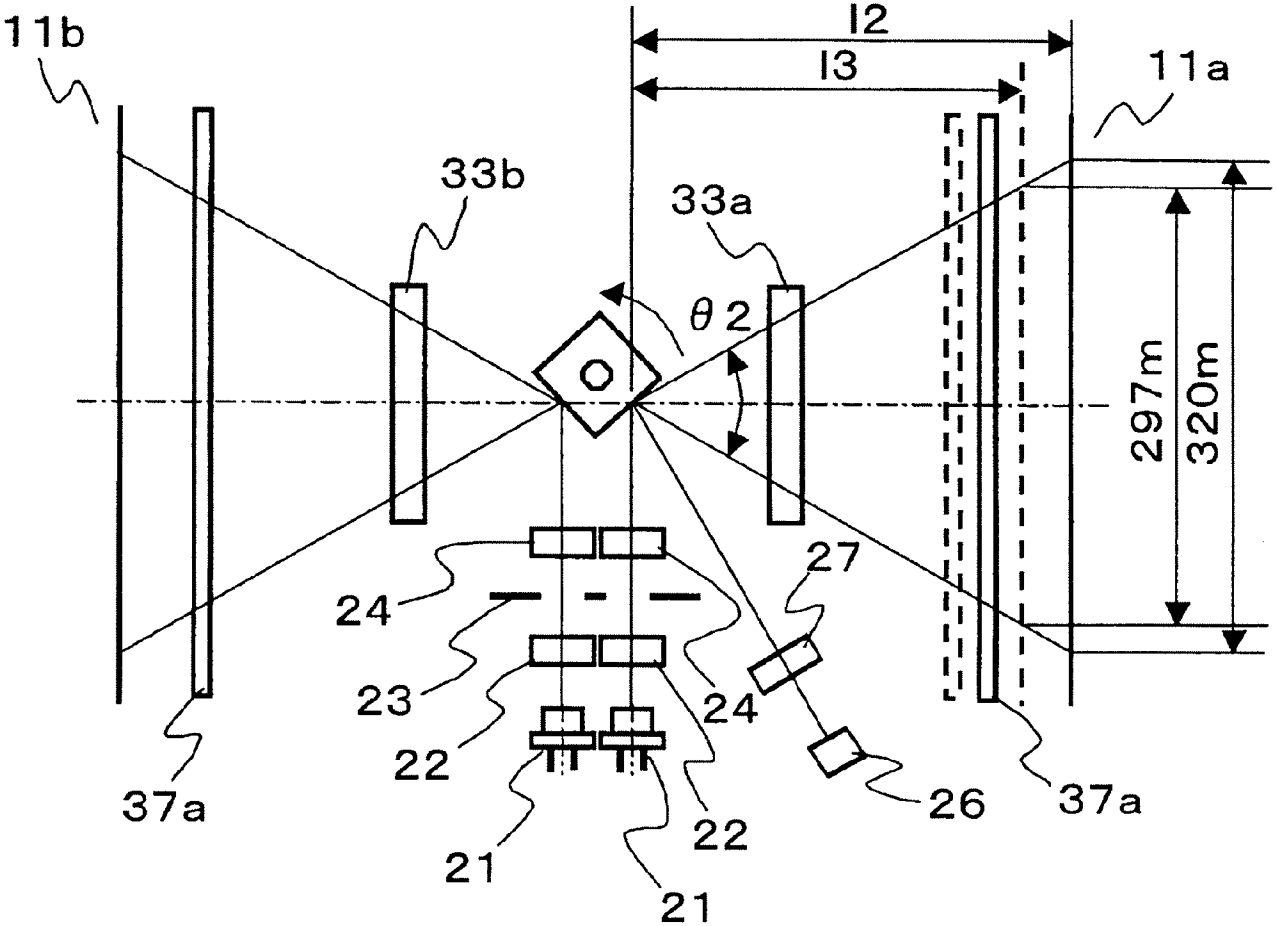
FIG. 6 is a plan exploded view of the second optical scanning device of the image forming apparatus according to this embodiment of the present invention in a state in which a reflection mirror thereof is removed.

FIG. 5 is a main sectional view of the second optical scanning device of another embodiment. FIG. 6 is a plan exploded view of the second optical scanning device in a state in which the reflection mirror is removed.

In FIG. 6, like reference numerals are attached to components having the same function as in FIG. 4, and a description thereof is omitted.

Reference numeral 32 denotes a polygon mirror which deflects and scans emitted laser beam, and the polygon mirror has four reflecting surfaces. The polygon mirror is rotated in the direction of an arrow in the figure. The lasers emitted by the first optical scanning device and the second optical scanning device have an identical wavelength in the embodiment.

Reference numeral 26 denotes synchronism detecting means and is arranged on the side in which the optical system deflected and scanned in the rightward direction in the figure is written. Writing of a beam deflected and scanned in the leftward direction of the figure is started after a predetermined time elapses since a synchronous signal is obtained by the synchronism detecting means.

Reference numerals 33*a* and 33*b* each denote a third image focusing lens for spot imaging the laser beam on the drum or a non-spherical lens having the fθ characteristic, which is formed of a resin material. Reference numerals 34*a* and 34*b* each denote a return mirror for reflecting laser beam having passed through the third image focusing lens in a predetermined direction, and reference numeral 35 denotes an optical box which supports and fixed respective optical elements. Reference numerals 37*a* and 37*b* each denote a dust-proof glass. In this embodiment, the third image focusing lenses 33*a* and 33*b* correspond to a focusing optical element of the present invention.

In the second optical scanning device, laser beam is emitted from two light sources, and deflected and scanned in the rightward and leftward directions in the figure by a polygon mirror arranged in the center.

In the second optical scanning device, the two third image focusing lenses 33*a*, 33*b* have an identical imaging performance.

In the second optical scanning device, image data is written while the light beam is deflected and scanned in the range of an angle θ2, and the scanning area at this time is in a range 320 mm in which the cutting marks can be formed.

The scanning angle θ2 is larger than the angle θ1 in the first optical scanning device and an optical path length 12 is shorter than the optical path length 11 so as to scan an identical area. In the meantime, in this embodiment, the length 12 is 250 mm, which is smaller by 50% than the length 11. Here, all optical path lengths from the first optical scanning device to the respective image bearing members are the same and all optical path lengths from the second optical scanning device to the respective image bearing members are the same.

The cutting mark which serves as a criterion for cutting is formed of a color having an excellent visibility, generally black. Even in the image forming apparatus which requires a scanning area of 320 mm including the cutting mark, the second optical scanning device for a pale color or a special color in which no cutting mark is formed may scan an image area of about 297 mm. Thus, in the second optical scanning device, to scan the area of 297 mm in the range of the angle θ2, the optical path length is set to 13, which is shorter than the 12. In the meantime, the length 13 is 230 mm in this embodiment.

In the second optical scanning device, in order to simplify the assembly thereof, the collimator lens and the cylindrical lens are fixed and arranged so as to form an optimum spot diameter on the drum arranged at the position 12 or 13 from the polygon mirror.

(Automatic Registration Control)

Measurement for a deviation amount and a color deviation amount of an image for adjustment of the image forming timing and image forming timing determining means (automatic registration) will be described with reference to FIG. 7.

Figure 7:
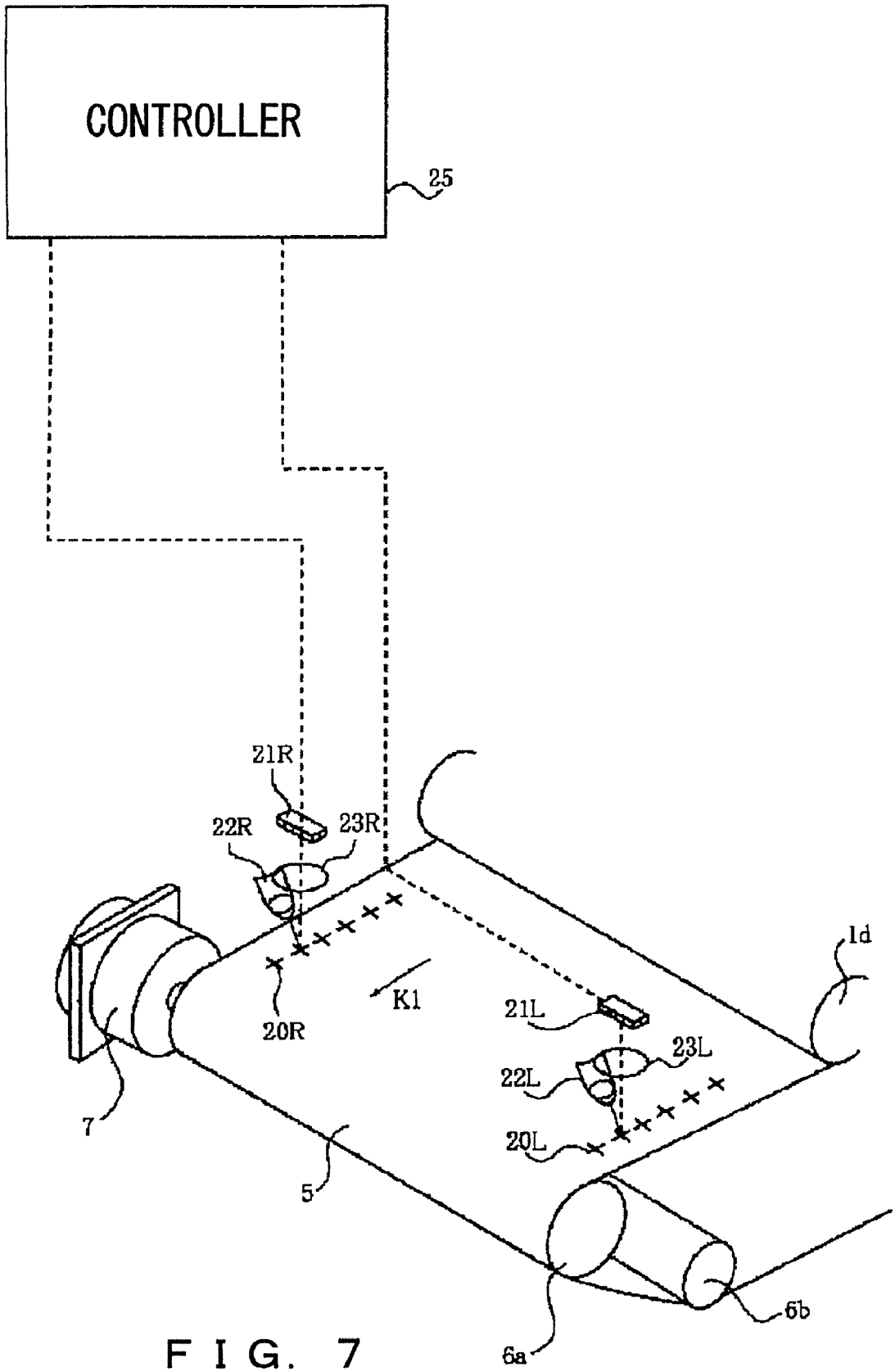
FIG. 7 is a diagram for explaining means for measuring a deviation amount and a color deviation amount of an image in the image forming apparatus according to this embodiment of the present invention.

In FIG. 7, 20L and 20R are "+" shaped registration marks which are formed at each position 140 mm relative to the center of an image in the main scanning direction in an image station including each photosensitive drum, and successively transferred to a belt 5 at a predetermined interval.

Reference numerals 21L and 21R each denote a mark detector constituted of a charge-coupled device such as a CCD, which receives reflection light of light irradiated from lamps 22L and 22R toward registration marks 20L and 20R through lenses 23L and 23R. The controller 25 detects the registration marks 20L and 20R.

The controller 25 detects and controls a deviation of write starting positions of other color images (for example, yellow, cyan and black) relative to a reference color image (for example, magenta), a magnification deviation, top margin deviation and scanning line inclination by detecting the registration marks 20L and 20R.

Each deviation is controlled in the first optical scanning device as follows.

The deviation of the write starting position is controlled by adjusting a time until an image is written from a beam detection signal obtained when a scanning light corresponding to each color passes beam detecting means (not shown).

The magnification deviation is controlled by adjusting the image clock. If the magnification is large with respect to the reference color image, the frequency of the image clock is increased at a predetermined ratio.

The top margin deviation is controlled by adjusting the scanning of the image data by selecting a surface of the rotary polyhedral mirror.

The scanning line inclination is controlled by driving the lens or the reflection mirror with an actuator (not shown).

Each deviation is controlled in the second optical scanning device as follows.

The deviation of the write starting position, the magnification deviation and the top margin deviation are adjusted electrically like in the first optical scanning device.

The scanning line inclination is adjusted by driving the reflection mirror with an actuator (not shown).

If the optical box is expanded with heat or deformed or the refraction factor of the lens is changed due to a rise in temperature within the image forming apparatus, the imaging position on the drum when the polygon mirror reflects the beam at a predetermined angle is changed.

To suppress the color deviation due to a change in the imaging position with a passage of time, automatic registration is carried out at a predetermined timing.

Because the automatic registration is carried out at other time than when an image is formed, productivity is lowered if the frequency of the operation is raised.

In the first optical scanning device of this embodiment, the color deviation due to changes in the refraction factor of the lens is suppressed by using the first image focusing lens near the polygon mirror which is likely to be heated (the temperature of a motor which rotates the polygon mirror is actually raised) in common. By forming the first image focusing lens using glass, the change in the refraction factor can be minimized. Here, cases of forming the first image focusing lens using a resin material (plastic lens) and a glass material (glass lens) will be described. The glass lens is more advantageous than the plastic lens in order to secure stability against an environmental change of the image quality (spot diameter). Although the plastic lens can be designed to generate no curvature of the field because it can be formed as an aspherical surface, it is inferior in stability of the spot diameter because the change of the refraction factor due to the environmental change is large. Because if the glass lens is used in an optical system having a short optical path length, the curvature of the field is increased so that the common depth becomes shallow, the glass lens is suitable for the optical scanning device having a long optical path length. Thus, it is permissible to form the first image focusing lens of the glass material and the second image focusing lens of the resin material.

Figure 8A:
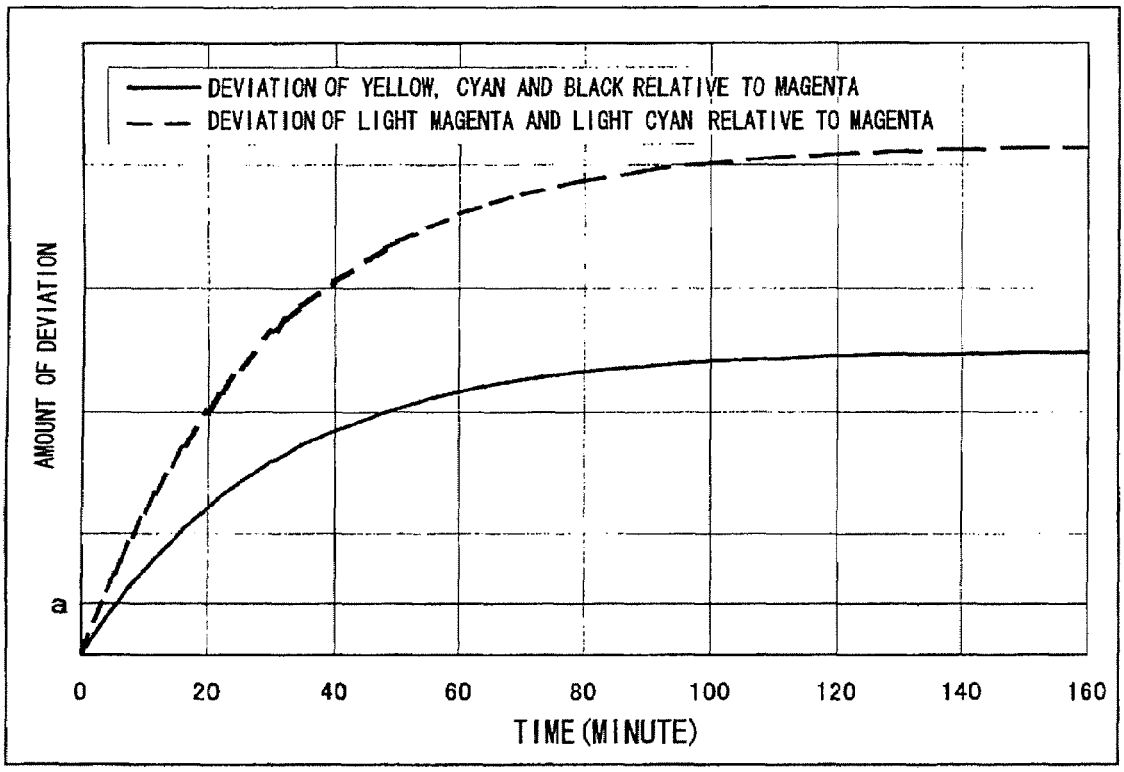
FIG. 8A is a graph showing a trend of changes in top margin deviation (deviation of top margin in the sub-scanning direction of an image) relative to a reference color, magnification deviation and scanning line gradient when the temperature rises.
Figure 8B:
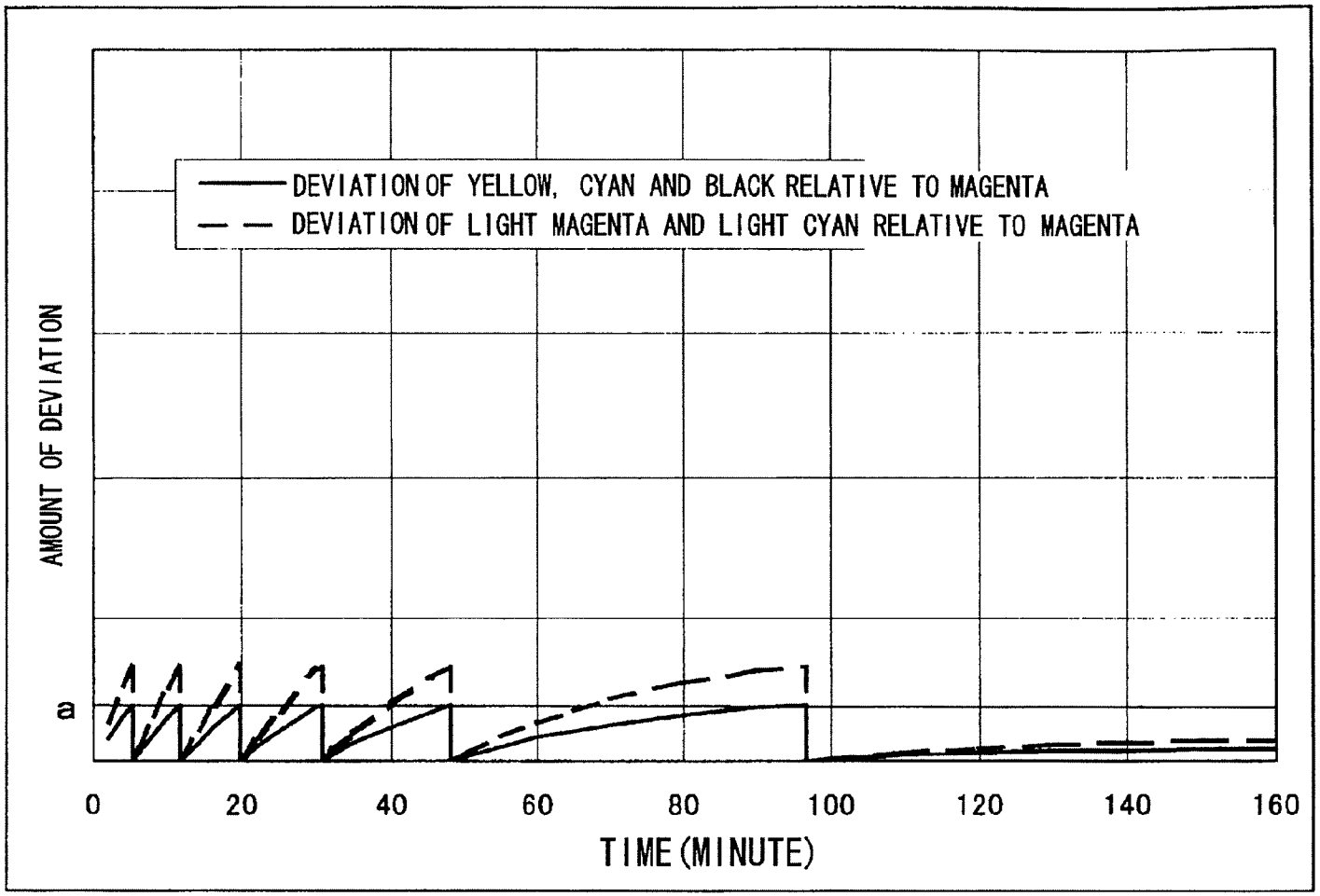
FIG. 8B is a graph showing changes in deviation amount when automatic registration is carried out at a predetermined timing in the image forming apparatus according to this embodiment of the present invention.
Figure 9:
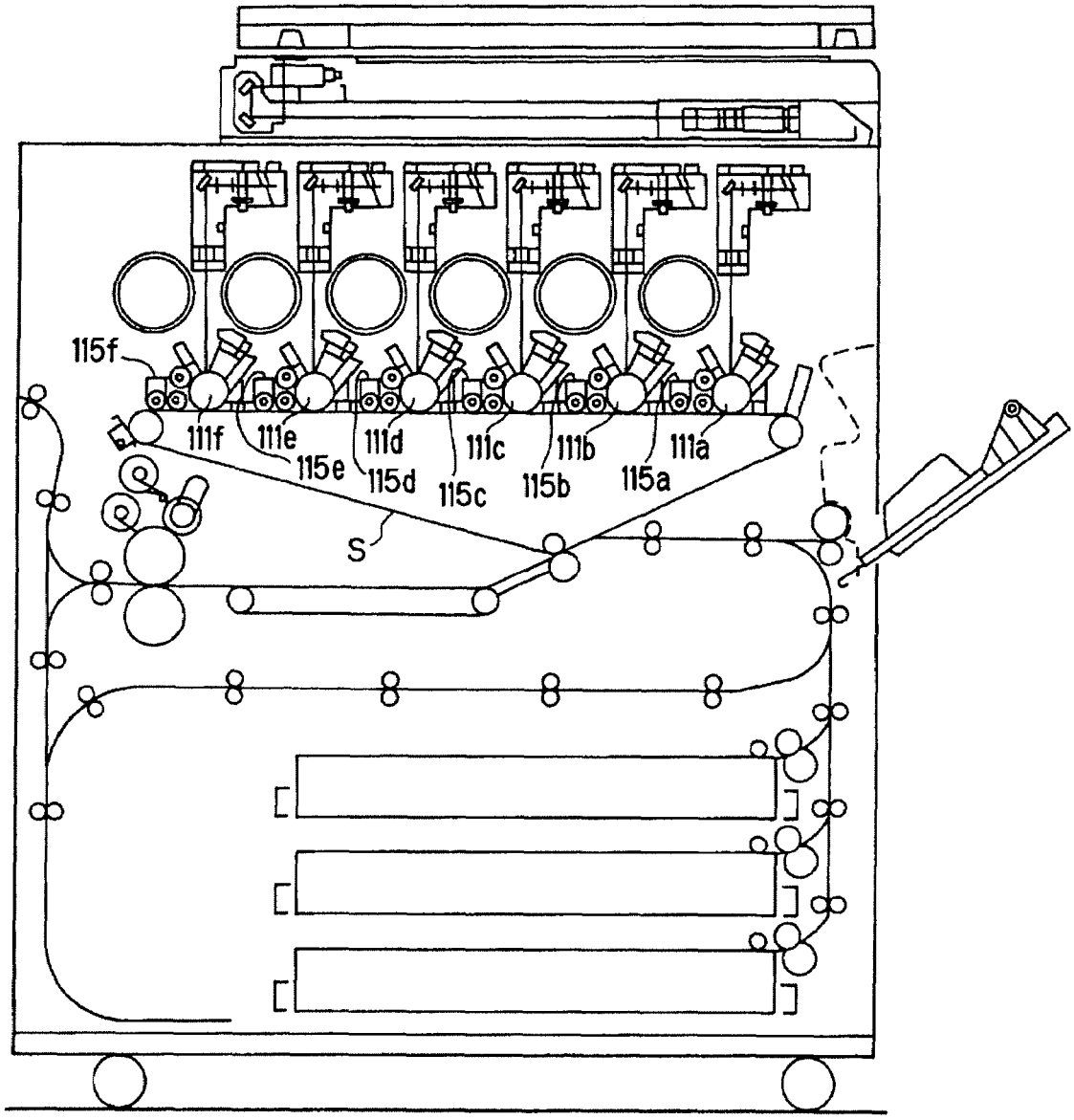
FIG. 9 is a diagram showing a conventional example of a tandem type multi-color image forming apparatus.
Figure 10:
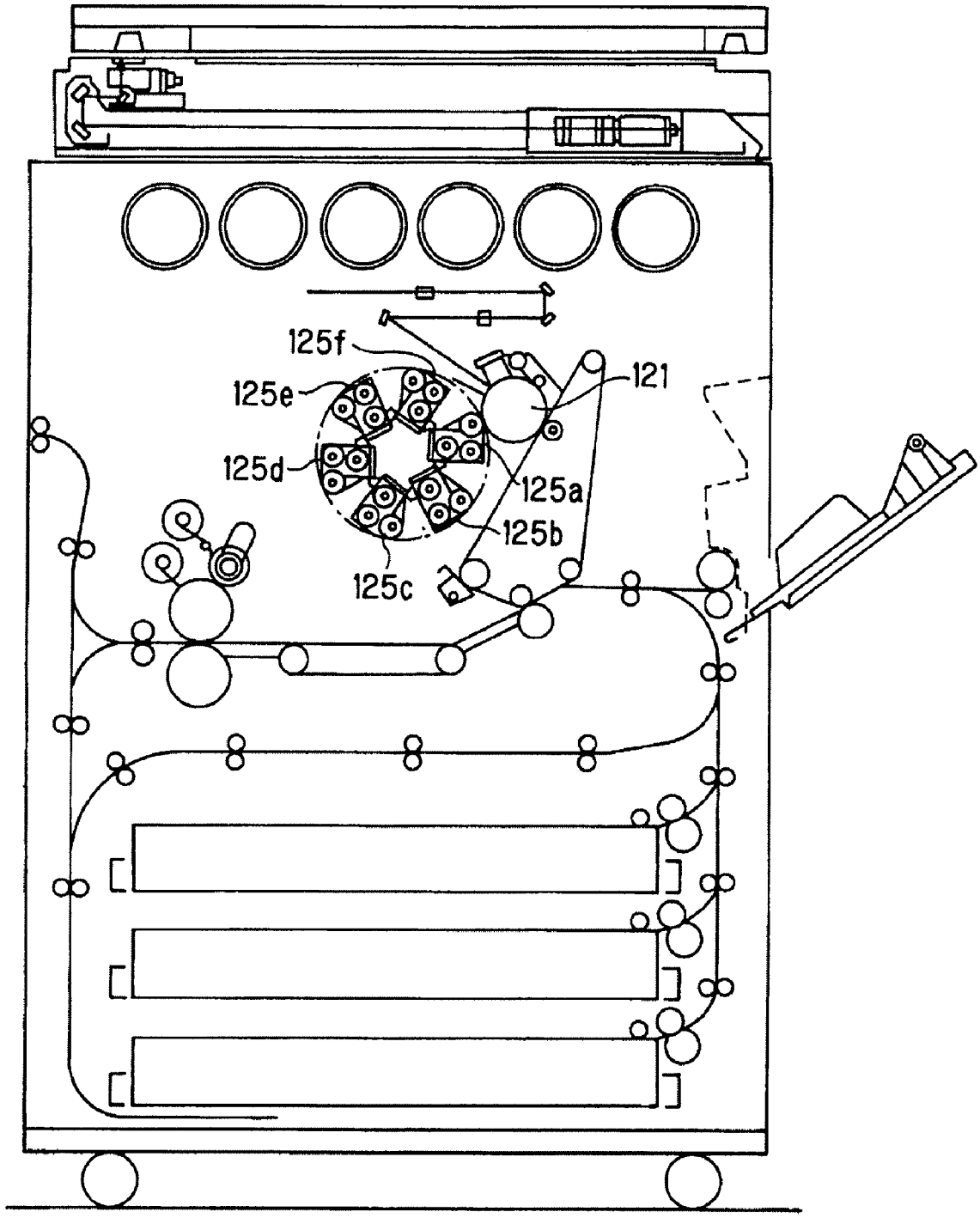
FIG. 10 is a diagram showing a multi-color image forming apparatus of type in which six development units are changed over to a single image bearing member.

FIGS. 8A and 8B show changes in the deviation amount with a passage of time and the deviation amount indicated on its abscissa axis and ordinate axis, respectively. The third image focusing lens provided in the second optical scanning device is formed of resin material and different from the optical system of the first optical scanning device. For this reason, the top margin deviation, magnification deviation and scanning line inclination of light magenta and light cyan with respect to the reference color (magenta) change with a tendency as shown with a dotted line in FIG. 8A as the temperature rises. In the meantime, FIG. 8A shows the top margin deviation and the like of yellow, cyan and black with respect to the reference color (magenta) with a solid line. As described above, color deviation in light magenta and light cyan is not easy to see. Thus, automatic registration is carried out so as to prevent yellow, cyan and black from exceeding a predetermined color deviation amount "a". In this embodiment, the automatic registration is carried out at a high frequency first and then, a time interval for executing the automatic registration is prolonged gradually. By such a control, the color deviation is progressed as shown in FIG. 8B.

As described above, use of the inexpensive, small second optical scanning device for light magenta and light cyan whose color deviation is not easy to see with respect to the reference color makes it possible to form a color image whose color deviation is not easy to see, without a necessity of realizing the small spot or increasing the frequency of the automatic registration. Although the second optical scanning device is employed for formation of the image using light magenta or light cyan toner, it may be used for formation of an image of any special color which is difficult to reproduce by mixing yellow, magenta and cyan.

Although in the above embodiment, light magenta and light cyan toners are employed as the special color, the present invention is not restricted to these colors but transparent toner or white toner may be used.

As described above, according to the present invention, in the image forming apparatus having not less than five image forming units, an influence on the color image can be minimized and an area occupied by the optical scanning device in the image forming apparatus can be reduced.

Although embodiments of the present invention have been described above, the present invention is not restricted to the above-described embodiments, but may be modified in every ways within the technical idea of the invention.

This application claims priority from

Japanese Patent Application No. 2006-145552 filed May 25, 2006, which hereby incorporated by reference herein.

What is claimed is:

1. An image forming apparatus comprising:

a plurality of image bearing members in which toner images are formed using toners of black, cyan, magenta and yellow colors;

a special color image bearing member in which toner image is formed using a special color toner of different colors from the black, cyan, magenta and yellow colors;

first optical scanning means for exposing an image on said plurality of image bearing members; and second optical scanning means for exposing an image on said special color image bearing member, wherein each optical path length of respective laser beams irradiated to said plurality of image bearing members is longer than that of laser beam irradiated to said special color image bearing member.

2. The image forming apparatus according to claim 1, wherein an image focusing optical element mounted on said first optical scanning means and an image focusing optical element mounted on said second optical scanning means have different imaging performances.

3. The image forming apparatus according to claim 1, wherein the number of faces reflecting a laser beam of a first rotary polygon mirror mounted on said first optical scanning means is different from the number of faces reflecting a laser beam of a second rotary polygon mirror mounted on said second optical scanning means.

4. The image forming apparatus according to claim 3, wherein the number of faces of said second rotary polygon mirror is smaller than the number of faces of said first rotary polygon mirror.

5. The image forming apparatus according to claim 1, wherein said special color toner is a transparent toner.

6. The image forming apparatus according to claim 1, wherein said special color toner is a toner having an identical hue with and lighter density than one of the black, cyan, magenta and yellow colors.

* * * * *